US011052658B2

(12) United States Patent
Hirai et al.

(10) Patent No.: US 11,052,658 B2
(45) Date of Patent: Jul. 6, 2021

(54) HEAD MODULE

(71) Applicant: Brother Kogyo Kabushiki Kaisha, Nagoya (JP)

(72) Inventors: Keita Hirai, Nagoya (JP); Shohei Koide, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/835,436

(22) Filed: Mar. 31, 2020

(65) Prior Publication Data

US 2020/0307202 A1 Oct. 1, 2020

(30) Foreign Application Priority Data

Apr. 1, 2019 (JP) ..... JP2019-069589

(51) Int. Cl.
*B41J 2/14* (2006.01)
*B41J 2/175* (2006.01)

(52) U.S. Cl.
CPC ..... *B41J 2/14145* (2013.01); *B41J 2/14032* (2013.01); *B41J 2/14201* (2013.01); *B41J 2/175* (2013.01); *B41J 2002/14306* (2013.01); *B41J 2002/14419* (2013.01)

(58) Field of Classification Search
CPC ..... B41J 2/055; B41J 2/14274; B41J 2/175; B41J 2/14201; B41J 2/14032; B41J 2/14145
USPC ..... 347/54, 68, 84, 85, 94
See application file for complete search history.

(56) References Cited

U.S. PATENT DOCUMENTS

| | | | | |
|---|---|---|---|---|
| 9,259,930 | B2 * | 2/2016 | Kimura | B41J 2/1612 |
| 9,623,658 | B2 * | 4/2017 | Yoshida | B41J 2/1612 |
| 10,022,963 | B2 * | 7/2018 | Kohda | B41J 2/055 |
| 2020/0031124 | A1 | 1/2020 | Kawamura et al. | |
| 2020/0254760 | A1 | 8/2020 | Ikeuchi et al. | |

FOREIGN PATENT DOCUMENTS

JP 2008-290292 A 12/2008

* cited by examiner

*Primary Examiner* — An H Do
(74) *Attorney, Agent, or Firm* — Banner & Witcoff, Ltd.

(57) ABSTRACT

A head module includes a pressure chamber, a piezoelectric member, a supply manifold, a return manifold, and a damper portion. The pressure chamber is configured to hold liquid therein and in fluid communication with a nozzle orifice. The piezoelectric member is configured to apply pressure to liquid held in the pressure chamber. The supply manifold is in fluid communication with the pressure chamber and configured to allow liquid to flow into the pressure chamber therefrom. The return manifold is in fluid communication with the pressure chamber and configured to allow liquid not ejected from the nozzle orifice to flow thereinto. The damper portion is positioned between the supply manifold and the return manifold when viewed in plan from a nozzle surface of the head module. The nozzle surface has the nozzle orifice defined therein. The damper portion includes a particular plate having a particular recessed portion.

15 Claims, 7 Drawing Sheets

HEAD MODULE

CROSS-REFERENCE TO RELATED APPLICATION

This application claims priority from Japanese Patent Application No. 2019-069589 filed on Apr. 1, 2019, the content of which is incorporated herein by reference in its entirety.

TECHNICAL FIELD

Aspects of the disclosure relate to a head module that ejects liquid such as ink.

BACKGROUND

Some known liquid ejection apparatus includes a tank and a head module. The tank stores liquid to be supplied to the head module. The head module ejects liquid such as ink. The head module includes a supply manifold (e.g., a liquid supply channel) and a return manifold (e.g., a liquid return channel). The supply manifold allows ink supplied from the tank to flow therethrough to nozzle orifices. The return manifold allows ink not ejected from one or more of the nozzle orifices to flow therethrough to return to the tank. When viewed from a nozzle surface of the head module, the supply manifold and the return manifold overlap each other, and more specifically, for example, the supply manifold and the return manifold are positioned one above the other, thereby reducing a size of the head module.

In the head module, for ejecting a liquid droplet from a particular nozzle orifice, pressure is applied to liquid in a corresponding pressure chamber by a corresponding piezoelectric member (e.g., a pressure application member). In such a configuration, residual vibration caused by a pressure wave may be transferred from the pressure chamber to the return manifold. Thus, the head module further includes a damper portion (e.g., an air damper) for releasing residual vibration transferred to the return manifold therefrom. The damper portion is positioned facing the return manifold.

SUMMARY

In such a head module, while the damper portion is provided facing the return manifold disposed below the supply manifold, no damper portion may be provided for the supply manifold disposed above the return manifold. Such a configuration might not thus sufficiently reduce effect of residual vibration transferred to the supply manifold from the pressure chamber.

Accordingly, aspects of the disclosure provide a head module that may reduce residual vibration effect both in a supply manifold and in a return manifold with a simple structure having relatively high handleability.

A head module includes a pressure chamber, a piezoelectric member, a supply manifold, a return manifold, and a damper portion. The pressure chamber is configured to hold liquid therein and in fluid communication with a nozzle orifice. The piezoelectric member is configured to apply pressure to liquid held in the pressure chamber. The supply manifold is in fluid communication with the pressure chamber and configured to allow liquid to flow into the pressure chamber therefrom. The return manifold is in fluid communication with the pressure chamber and configured to allow liquid not ejected from the nozzle orifice to flow thereinto. The damper portion is positioned between the supply manifold and the return manifold when viewed in plan from a nozzle surface of the head module. The nozzle surface has the nozzle orifice defined therein. The damper portion includes a particular plate having a particular recessed portion.

DETAILED DESCRIPTION

A head module according to an illustrative embodiment will be described with reference to the accompanying drawings. In the description below, the head module may be, for example, an inkjet head module that may eject ink onto a recording sheet.

Configuration of Liquid Ejection Apparatus

Figure 1:
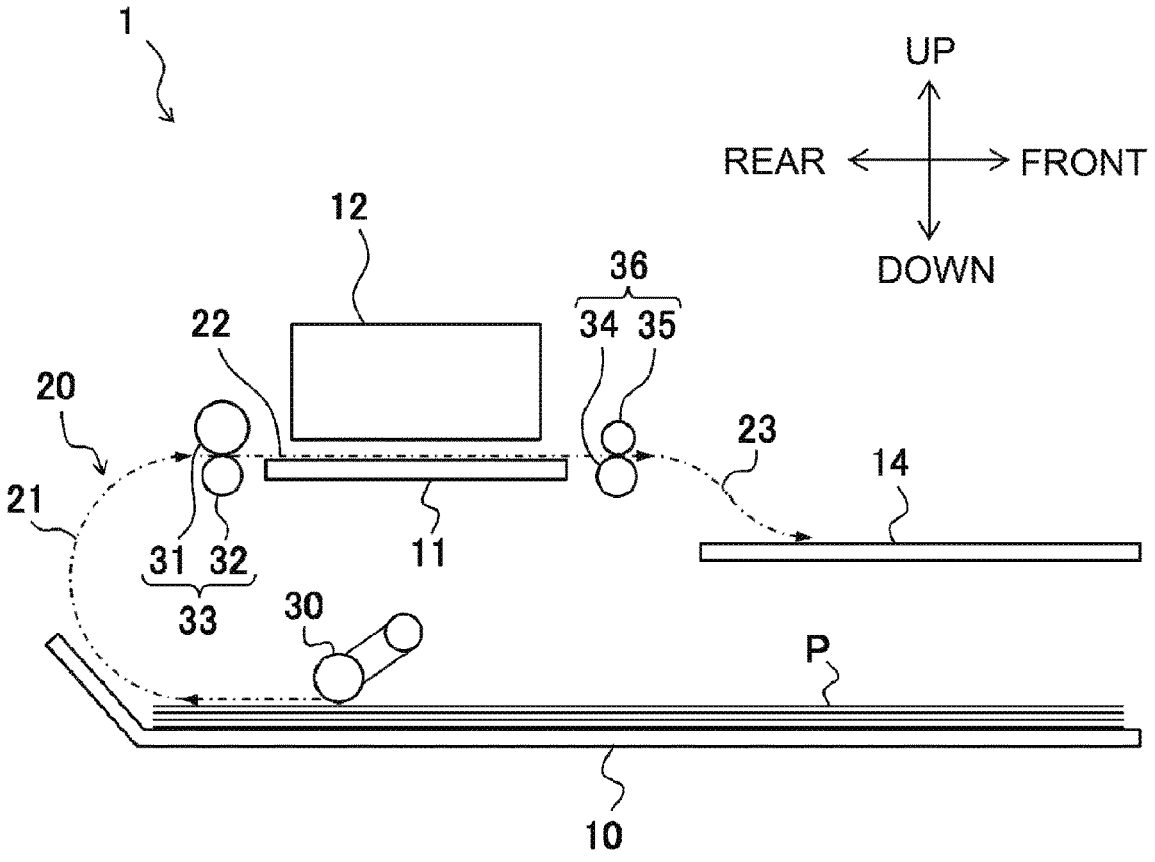
FIG. 1 is a schematic diagram illustrating a general configuration of a liquid ejection apparatus according to an illustrative embodiment of the disclosure.

As illustrated in FIG. 1, a liquid ejection apparatus 1 includes a feed tray 10, a platen 11, and a line head 12, which are disposed one above another in this order from below. The feed tray 10 is configured to store one or more recording sheets P. The platen 11 is disposed above the feed tray 10. The platen 11 has longer sides extending along a perpendicular direction that is perpendicular to a direction in which a recording sheet P is conveyed (hereinafter, referred to as the conveyance direction). The platen 11 may be a plate like member. The platen 11 is configured to support from below a recording sheet P being conveyed. The line head 12 is disposed above the platen 11. The line head 12 includes a plurality of head modules 13. The liquid ejection apparatus 1 further includes a discharge tray 14. The discharge tray 14 is disposed in front of the platen 11. The discharge tray 14 is configured to receive a recording sheet P having undergone printing.

The liquid ejection apparatus 1 has a sheet conveyance path 20. The sheet conveyance path 20 extends from a rear end of the feed tray 10. The sheet conveyance path 20 connects between the feed tray 10 and the discharge tray 14. The sheet conveyance path 20 includes three sections including a curved path section 21, a straight path section 22, and a last path section 23. The curved path section 21 extends curvedly upward from a rear portion of the feed tray 10 to a vicinity of a rear end of the platen 11. The straight path section 22 extends to a vicinity of a front end of the platen 11 from the end of the curved path section 21 beyond the front end of the platen 11. The last path section 23 extends to the discharge tray 14 from the end of the straight path section 22.

The liquid ejection apparatus 1 further includes a feed roller 30, a conveyance roller 31, and a discharge roller 34, which may constitute a sheet conveyor that conveys a recording sheet P. The sheet conveyor is configured to convey a recording sheet P along the sheet conveyance path 20 from the feed tray 10 to the discharge tray 14 in the conveyance direction.

More specifically, for example, the feed roller 30 is disposed directly above the feed tray 10. The feed roller 30 may contact a recording sheet P from above. The conveyance roller 31 is paired with a pinch roller 32 to constitute a conveyance roller unit 33. The conveyance roller unit 33 is disposed at a vicinity of a downstream end of the curved path section 21 in the conveyance direction. The conveyance roller unit 33 is disposed at a boundary between the curved path section 21 and the straight path section 22 and connect therebetween. The discharge roller 34 is paired with a spur roller 35 to constitute a discharge roller unit 36. The discharge roller unit 36 is disposed at a vicinity of a downstream end of the straight path section 22 in the conveyance direction. The discharge roller unit 36 is disposed at a boundary between the straight path section 22 and the last path section 23 and connect therebetween.

The feed roller 30 is configured to feed a recording sheet P to the conveyance roller unit 33 along the curved path section 21. The conveyance roller unit 33 is configured to convey a recording sheet P fed by the feed roller 30 to the discharge roller unit 36 along the straight path section 22. The head modules 13 are configured to eject ink onto a recording sheet P that is being conveyed along the platen 11 in the straight path section 22, thereby recording an image onto the recording sheet P. The discharge roller unit 36 is configured to convey a recording sheet P having undergone printing to the discharge tray 14.

Figure 2:
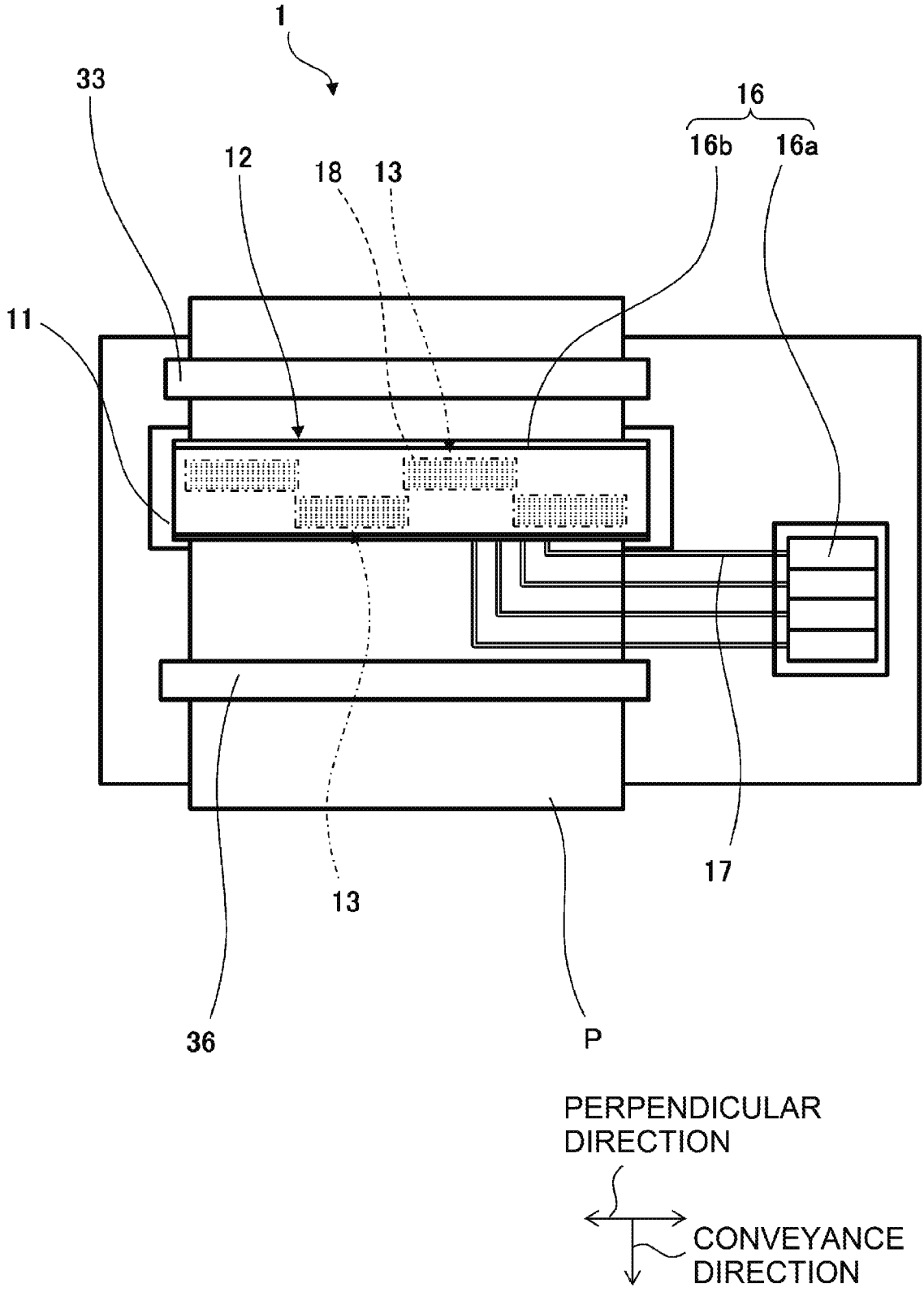
FIG. 2 is a schematic top plan view illustrating the general configuration of the liquid ejection apparatus according to the illustrative embodiment of the disclosure.

As illustrated in FIG. 2, the line head 12 has a lower surface that may face a surface of a recording sheet P. The line head 12 has a width greater than or equal to a width of a recording sheet P in the perpendicular direction perpendicular to the conveyance direction. The lower surface of the line head 12 has nozzle orifices 18 of individual channels 100 (refer to FIGS. 3A and 3B). The lower surface of the line head 12 may include a nozzle surface.

The liquid ejection apparatus 1 further includes a plurality of tanks 16. The tanks 16 are connected to corresponding nozzle orifices 18. Each tank 16 includes a sub tank 16*b* and a storage tank 16*a*. The sub tank 16*b* is disposed on the line head 12. The storage tank 16*a* is connected to the sub tank 16*b* via a tube 17. The sub tanks 16*b* and the storage tanks 16*a* each hold liquid therein. The number of tanks 16 provided corresponds to the number of colors of liquid to be ejected from the nozzle orifices 18. In the illustrative embodiment, for example, four tanks 16 are provided for four colors (e.g., black, yellow, cyan, and magenta) of liquid. Thus, the line head 12 may eject different kinds or types (e.g., colors) of liquid.

As described above, the line head 12 is fixed to a particular position and is configured to eject liquid from appropriate ones of the nozzle orifices 18. The sheet conveyor is configured to, in response to such ejection, convey a recording sheet P in the conveyance direction to record an image onto the recording sheet P.

In the illustrative embodiment, the head modules 13 constitute a line head. Nevertheless, in other embodiments, for example, the head modules 13 may constitute a serial head instead of the line head.

Configuration of Head Module

Figure 3A:
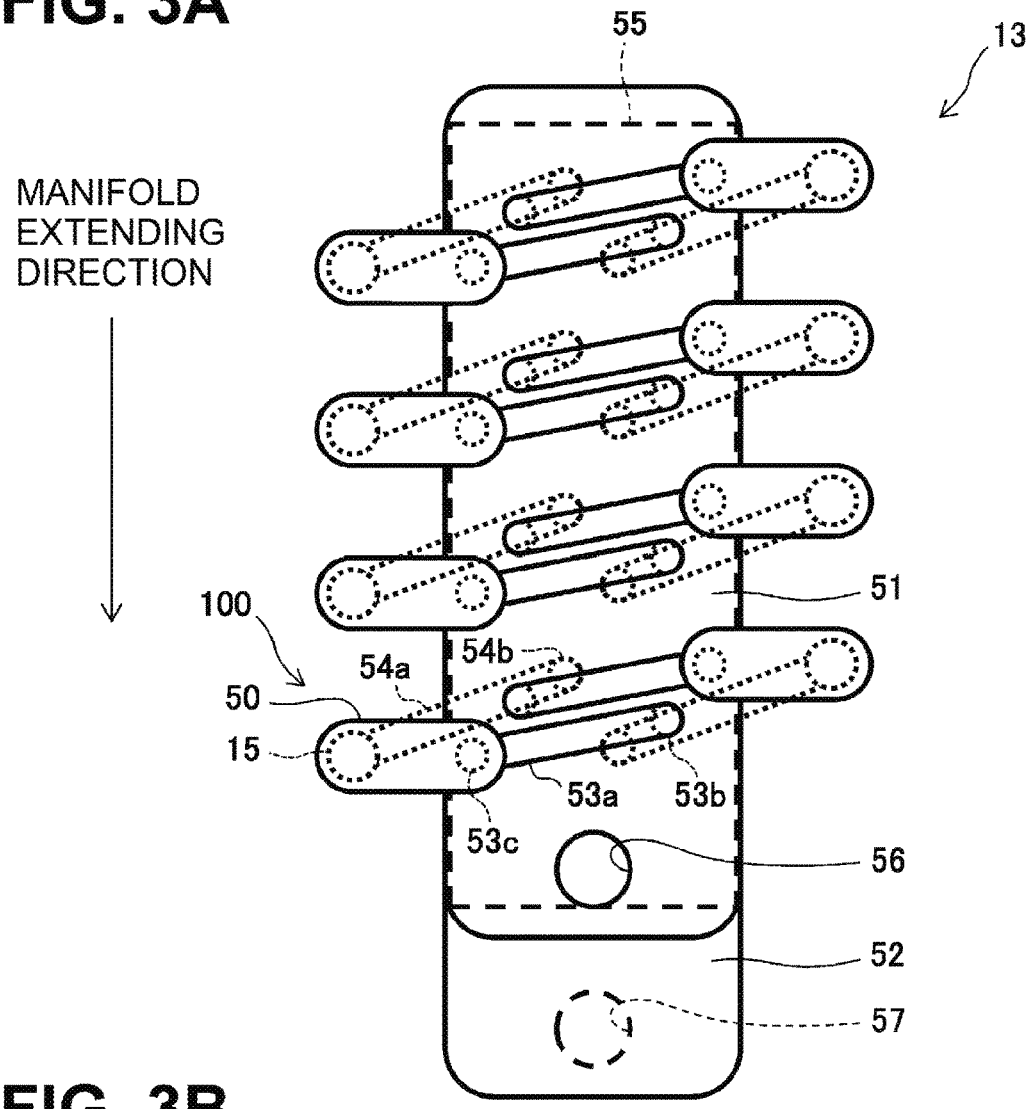
FIG. 3A is a partially enlarged schematic view of a head module of the liquid ejection apparatus of FIG. 1 according to the illustrative embodiment of the disclosure, illustrating a planar structure of the head module.
Figure 3B:
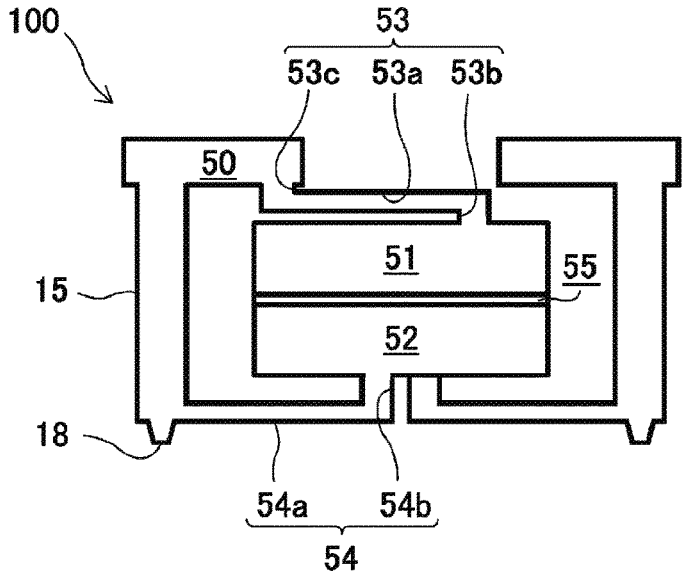
FIG. 3B is a partially enlarged schematic view of the head module of the liquid ejection apparatus of FIG. 1 according to the illustrative embodiment of the disclosure, illustrating a cross sectional structure of the head module.
Figure 4:
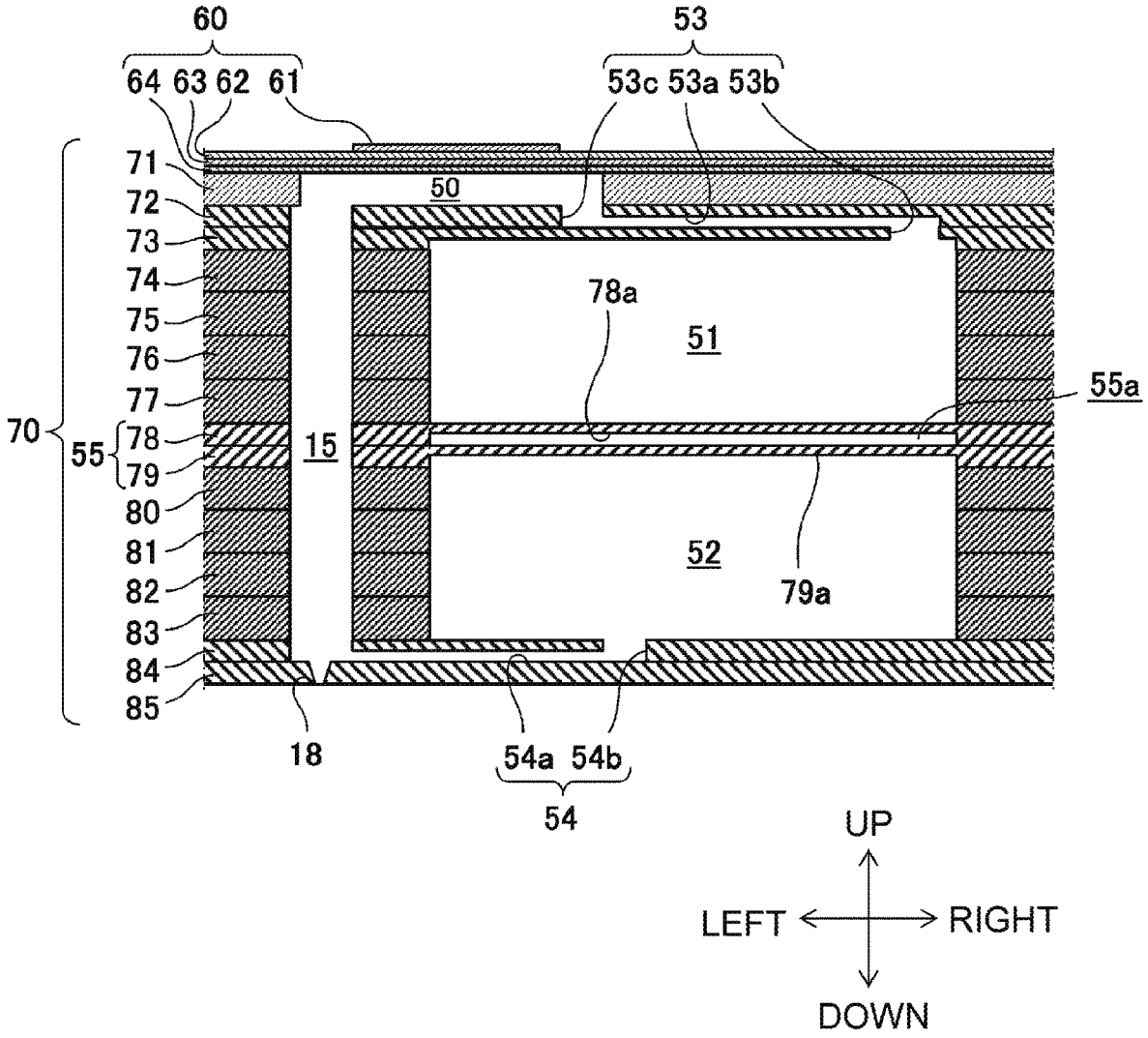
FIG. 4 is a sectional view illustrating a detailed configuration of a particular individual channel of the head module of FIG. 3A including a damper portion according to the illustrative embodiment of the disclosure.

All of the head modules 13 may have the same configuration, and therefore, one of the head modules 13 will be described below. Referring to FIGS. 3A, 3B and 4, a configuration of a head module 13 will be described. The head module 13 includes a piezoelectric plate 60 that is disposed above pressure chambers 50. Nevertheless, for purposes of convenience, in FIG. 3A and 3B, the piezoelectric plate 60 is not illustrated.

As illustrated in FIG. 3A, the head module 13 includes a plurality of individual channels 100 aligned along one direction. In the liquid ejection apparatus 1, liquid is supplied to the head module 13 from a corresponding tank 16 to flow into the first supply manifold 51 via an inlet 56. Liquid then flows through the supply manifold 51 mainly in one direction to each individual channel 100. All of the individual channels 100 may have the same configuration, and therefore, one of the individual channels 100 will be described in detail.

An individual channel 100 includes a pressure chamber 50, a descender 15, and a nozzle orifice 18. The descender 15 is in fluid communication with the pressure chamber 50. The nozzle orifice 18 is in fluid communication with the descender 15 and is configured to allow a liquid droplet to be ejected therefrom. A direction toward which the surface of the head module 13 that has the nozzle orifice 18 (i.e., the nozzle surface) faces may be defined as a down direction, and a direction opposite to the down direction may be defined as an up direction. With respect to the defined directions, the pressure chamber 50 is disposed above the descender 15. As illustrated in FIG. 4, the piezoelectric plate 60 (e.g., a piezoelectric member) is disposed above the pressure chamber 50. The piezoelectric plate 60 is configured to apply pressure to liquid in the pressure chamber 50. More specifically, for example, in response to application of a voltage to the piezoelectric plate 60, the piezoelectric plate 60 deforms to apply pressure to liquid in the pressure chamber 50. Thus, the head module 13 may eject a liquid droplet from the nozzle orifice 18 corresponding to the pressure chamber 50.

The individual channel 100 includes a liquid supply path 53. The liquid supply path 53 connects between the supply manifold 51 and the pressure chamber 50 of the individual channel 100. The supply manifold 51 is at a positive pressure for allowing liquid to flow into the pressure chamber 50.

The head module 13 further includes a return manifold 52 and an outlet 57 for allowing liquid not ejected from the nozzle orifice 18 to further flow in the head module 13. The return manifold 52 is configured to temporarily hold liquid therein. The outlet 57 is configured to allow liquid to flow out of the return manifold 52 to return to a corresponding tank 16. As illustrated in FIG. 3A, when viewed in plan from the nozzle surface, the outlet 57 of the return manifold 52 might not overlap the inlet 56 of the supply manifold 51. That is, the return manifold 52 extends beyond the supply manifold 51 in a manifold extending direction. The outlet 57 and the inlet 56 are apart from each other in the manifold extending direction. The individual channel 100 further includes a liquid return path 54. The liquid return manifold 54 connects between the nozzle orifice 18 of the individual channel 100 and the return manifold 52. The return manifold 52 is at a negative pressure for allowing liquid not ejected from the nozzle orifice 18 to flow thereinto.

The liquid supply path 53 includes a supply narrowed portion 53*a* that extends from the supply manifold 51 toward the pressure chamber 50. The liquid supply path 53 has an entrance 53*b* at one end of the supply narrowed portion 53*a* and an exit 53*c* at the other end of the supply narrowed portion 53*a*. The liquid supply path 53 is connected to the supply manifold 51 via the entrance 53*b* and connected to the pressure chamber 50 via the exit 53*c*. The supply narrowed portion 53*a* has a narrower flow path diameter than a diameter of the entrance 53*b* and a diameter of the exit 53*c*. As described above, the supply narrowed portion 53*a* having the narrow path diameter is positioned between the pressure chamber 50 and the supply manifold 51 in a liquid flow route, thereby reducing or preventing liquid from flowing back to the supply manifold 51 from the pressure chamber 50 when pressure is applied to liquid in the pressure chamber 50 by deformation of the piezoelectric plate 60 to force liquid to flow from the pressure chamber 50.

The liquid return path 54 includes a return narrowed portion 54*a*. The return narrowed portion 54*a* extends from the nozzle orifice 18 toward the return manifold 52 and is connected to the nozzle orifice 18 and the descender 15 at one end portion thereof. The liquid return path 54 has an exit 54*b* at the other end of the return narrowed portion 54*a*. The liquid return path 54 is connected to the return manifold 52 via the exit 54*b*. The return narrowed portion 54*a* has a narrower flow path diameter than a diameter of the exit 54*b*. As described above, the return narrowed portion 54*a* having the narrow path diameter is positioned between the pressure chamber 50 and the return manifold 52 in a liquid flow route, thereby reducing or preventing most of liquid forced to flow from the pressure chamber 50 by deformation of the piezoelectric plate 60 from flowing to the return manifold 52 via the liquid return path 54. Consequently, such a configuration may reduce or prevent insufficient ejection of liquid from the nozzle orifice 18.

The supply manifold 51 and the return manifold 52 overlap each other when viewed in plan from the nozzle surface having the nozzle orifice 18. The head module 13 further includes a damper portion 55 between the supply manifold 51 and the return manifold 52. The damper portion 55 may reduce effect of residual vibration propagating to the supply manifold 51 from the pressure chamber 50 via the liquid supply path 53 and effect of residual vibration propagating to the return manifold 52 from the pressure chamber 50 via the liquid return path 54.

The other individual channels 100 are also connected to the supply manifold 51 and the return manifold 52 in the same manner. That is, the plurality of individual channels 100 are connected to the supply manifold 51 via the respective corresponding liquid supply paths 53 and to the return manifold 52 via the respective corresponding liquid return paths 54.

In one example, as illustrated in FIG. 4, the portions and channels of the head module 13 may be formed by lamination of a plurality of plates that have undergone etching (half etching) or cutting. In another example, the portions and channels of the head module 13 may be formed by lamination of a plurality of resin-made plates molded in respective particular shapes.

As illustrated in FIG. 4, the head module 13 further includes a channel unit 70 and the piezoelectric plate 60. The channel unit 70 includes a lamination of a plurality of plates 71 to 85. The piezoelectric plate 60 is adhered to an upper surface of the channel unit 70. The piezoelectric plate 60 functions as an actuator.

The piezoelectric plate 60 is positioned on an upper surface of the plate 71 of the channel unit 70 so as to overlap the pressure chambers 50 in a direction in which the plates 71 to 85 of the channel unit 70 are laminated one above another (hereinafter, referred to as the laminating direction). The piezoelectric plate 60 includes individual electrodes 61, a piezoelectric layer 62, a common electrode 63, and a vibration plate 64 that are laminated in this order from above. The piezoelectric layer 62, the common electrode 63, and the vibration plate 64 are provided in common for the pressure chambers 50. The individual electrodes 61 are provided in a one-to-one correspondence with the pressure chambers 50. The piezoelectric layer 62 may be made of, for example, piezoelectric material, e.g., lead zirconate titanate (PZT).

The common electrode 63 is maintained at the ground potential. The individual electrodes 61 are connected to a driver IC of the liquid ejection apparatus 1. Each individual electrode 61 is maintained at the ground potential or at a certain drive potential by the driver IC. Each portion sandwiched between a particular portion of a common electrode 63 and a particular individual electrode 61 may be polarized in the laminating direction when the individual electrode 61 is energized, and each portion may function as an active portion.

In the piezoelectric plate 60, in a state where the head module 13 does not allow ejection of liquid droplets from the respective nozzle orifices 18 (e.g., a standby state), all of the individual electrodes 61 are maintained at the ground potential as with the common electrode 63. For ejecting a liquid droplet from a particular nozzle orifice 18, a controller causes an individual electrode 61 corresponding to a pressure chamber 50 that is in fluid communication with the particular nozzle orifice 18 to be at the certain drive potential. In response to the potential change of the individual electrode 61, a particular portion of the piezoelectric plate 60 corresponding to the individual electrode 61 is deformed to protrude toward the pressure chamber 50. The deformation of the particular portion of the piezoelectric plate 60 causes decrease of the volume of the pressure chamber 50 to increase the pressure (e.g., the positive pressure) applied to liquid in the pressure chamber 50, thereby causing liquid droplet ejection from the particular nozzle orifice 18. After the liquid droplet ejection, the potential of the individual electrode 61 is changed back to the ground potential. Thus, the particular portion of the piezoelectric plate 60 is returned to the state before deformation.

The controller causes a particular portion of the piezoelectric plate 60 corresponding to a particular nozzle orifice 18 that is not allowed to eject liquid therefrom to be deformed away from liquid in a pressure chamber 50. More specifically, for example, the particular portion of the piezoelectric plate 60 is deformed to concave relative to the pressure chamber 50 corresponding to the particular nozzle orifice 18. The deformation of the particular portion of the piezoelectric plate 60 causes increase of the volume of the pressure chamber 50, thereby causing the pressure acting on liquid in the pressure chamber 50 to be at a negative pressure. Such a control may thus prevent liquid ejection from the particular nozzle orifice 18 that is not targeted for liquid ejection. There has been various known manners for controlling a voltage to be applied to a particular portion of the piezoelectric plate 60 for causing liquid ejection from a corresponding nozzle orifice 18. The voltage control manner applied to the head module 13 is not limited to the specific example described above. In other embodiments, another known manner may be applied to the head module 13.

The channel unit 70 includes the plates 71 to 85 laminated in this order from above. The channel unit 70 includes nozzle orifices 18 in its lower surface. The channel unit 70 is configured to eject liquid downward from the nozzle orifices 18.

The plate 71 has through holes penetrating therethrough in the laminating direction. The piezoelectric plate 60 is disposed on an upper surface of the plate 71 and the plate 72 is disposed on a lower surface of the plate 71. That is, each through hole of the plate 71 are sandwiched between the piezoelectric plate 60 and the plate 72 to define a respective pressure chamber 50.

The plate 72 has recessed portions in its lower surface. Each recessed portion extends in a right-left direction. The plate 72 further has through holes, each of which penetrates therethrough in the laminating direction so as to be in fluid communication with a corresponding pressure chamber 50. Each recessed portion has one of the through holes at its one end portion (e.g., a left end portion in FIG. 4). The one end portion may be closer to a corresponding pressure chamber 50 than the other end portion opposite thereto to the corresponding pressure chamber 50. The through holes of the plate 72 may serve as the exits 53*c* of the respective liquid supply paths 53. The recessed portions of the plate 72 and the plate 73 define the supply narrowed portions 53*a* therebetween.

The plate 73 has through holes, each of which penetrates therethrough in the laminating direction so as to provide fluid communication between a corresponding liquid supply path 53 and the supply manifold 51 at the other end portion of a corresponding recessed portion of the plate 72. The through holes of the plate 73 may serve as the entrances 53*b* of the respective liquid supply paths 53. The plate 73 has a recessed portion in its lower surface. The recessed portion of the plate 73 may serve as an upper portion of the supply manifold 51.

The plate 73, the plates 74 to 77 each having a through hole penetrating therethrough in the laminating direction, and the plate 78 define the supply manifold 51.

The plate 79 has a recessed portion in its lower surface. The recessed portion of the plate 79 may serve as an upper portion of the return manifold 52.

The plate 79, the plates 80 to 83 each having a through hole penetrating therethrough in the laminating direction, and the plate 84 define the return manifold 52.

Each of the plates 72 to 84 has another through holes each penetrating therethrough in the laminating direction. Each pressure chamber 50 has one end portion that is in fluid communication with a corresponding liquid supply path 53 and the other end portion opposite thereto. The through hole of each of the plates 72 to 84 extends in the laminating direction so as to be in fluid communication with the other end portion of a corresponding pressure chamber 50. The plate 85 has holes each gradually tapered downward. That is, through holes included in the respective plates 72 to 84 and being in fluid communication with each other define a descender 15 and a hole of the plate 85 being in fluid communication with the through holes define a nozzle orifice 18.

The plate 84 has through holes and recessed portions. Each through hole defines a portion of a corresponding descender 15. Each recessed portion extends in the right-left direction and in fluid communication with a corresponding nozzle orifice 18 of the plate 85. The recessed portions of the plate 84 and the plate 85 define return narrowed portions 54*a* therebetween. The plate 84 has another through holes, each of which penetrates therethrough in the laminating direction so as to be in fluid communication with the return manifold 52. Each recessed portion has one of the through holes at its one end portion (e.g., a right end portion in FIG. 4). The one end portion may be opposite to the other end portion having the through hole defining a portion of a corresponding descender 15. The through holes that are in fluid communication with the return manifold 52 may serve as the exits 54*b* of the return narrowed portions 54*a*.

The recessed portion 78*a* of the plate 78 and the recessed portion 79*a* of the plate 79 constitute the damper portion 55. The plate 78 serves as one of outer walls defining the supply manifold 51, for example, a lower wall of the supply manifold 51. The plate 79 serves as one of outer walls defining the return manifold 52, for example, an upper wall of the return manifold 52. Hereinafter, a configuration of the damper portion 55 will be described in detail. The plate 78 may also be referred to as a particular plate. The plate 79 may also be referred to as a further particular plate.

Damper Portion

As illustrated in FIG. 4, the plate 78 and the plate 79 have the recessed portions 78*a* and 79*a*, respectively, in their lower surfaces. The plate 78 and the plate 79 are laminated one above the other to provide a damper space 55*a* between the surface of the plate 78 where the recessed portion 78*a* is defined (e.g., the lower surface of the plate 78) and the surface of the plate 79 where the recessed portion 79*a* is not defined (e.g., an upper surface of the plate 79). In each of the plates 78 and 79, the portion having the recessed portion 78*a* or 79*a* has a less thickness than the other portions. With such a configuration, in response to residual vibration propagating in the supply manifold 51, the recessed portion 78*a* of the plate 78 is deformed and thus air in the damper space 55*a* may absorb the residual vibration. In response to residual vibration propagating in the return manifold 52, the recessed portion 79*a* of the plate 79 is deformed and thus air in the damper space 55*a* may absorb the residual vibration.

As described above, the damper portion 55 consists of the recessed portion 78*a* of the plate 78 and the recessed portion 79*a* of the plate 79. The plates having the respective recessed portions 78*a* and 79*a* may have a moderate thickness. In the illustrative embodiment, the plate 78 having the recessed portion 78*a* and the plate 79 having the recessed portion 79*a* each have a moderate thickness. Consequently, as compared with a case where extremely thin films are used for defining the damper portion 55, the plates 78 and 79 each having a moderate thickness may have higher handleability in manufacturing.

The damper space 55*a* of the damper portion 55 may be provided by the plates 78 and 79, each of which has a recessed portion in its particular surface to partially reduce its thickness. That is, the damper portion 55 consists of two plates (e.g., the plates 78 and 79).

The damper portion 55 is positioned between the supply manifold 51 and the return manifold 52. Such an arrangement may thus enable the damper space 55*a* to be used both for absorbing residual vibration propagating in the supply manifold 51 and for absorbing residual vibration propagating in the return manifold 52.

That is, the damper portion 55 might not require other plates for defining a damper space for absorbing residual vibration propagating in the supply manifold 51 and for defining a damper space for absorbing residual vibration propagating in the return manifold 52. Consequently, the number of plates required for defining the damper portion 55 may be reduced, thereby enabling the channel unit 70 to have a simple structure.

In one example, the damper space 55*a* of the damper portion 55 may be a closed space. Such a configuration may reduce or prevent intrusion of liquid such as ink into the damper space 55*a*, thereby not causing interruption of deformation of the portion of the plate 78 where the recessed portion 78*a* is defined and deformation of the portion of the plate 79 where the recessed portion 79*a* is defined due to intrusion of liquid into the damper space 55*a*.

In another example, the damper portion 55 may further include a communication portion that may be a flow path providing fluid communication between the damper space 55*a* and atmosphere. In such a configuration, air in the damper space 55*a* may be released to the atmosphere via the communication portion by deformation of the recessed portion 78*a* of the plate 78 or by deformation of the recessed portion 79*a* of the plate 79. Consequently, air resistance acting in the damper space 55*a* relative to deformation of the portion of the plate 78 where the recessed portion 78*a* is defined or relative to deformation of the portion of the plate 79 where the recessed portion 79*a* is defined may be reduced, thereby increasing absorbance of residual vibration.

In FIG. 4, in the damper portion 55, the surface of the plate 78 where the recessed portion 78*a* is defined and the surface of the plate 79 where the recessed portion 79*a* is defined face the same direction in the laminating direction. In one example, as illustrated in FIG. 4, the plate 78 may have the recessed portion 78*a* in its lower surface and the plate 79 may have the recessed portion 79*a* in its lower surface. The recessed portion 78*a* of the plate 78 may define the damper space 55*a* and the recessed portion 79*a* of the plate 79 may define an upper portion of the return manifold 52. Such a configuration may thus increase the volume of the return manifold 52. In another example, the plate 78 may have the recessed portion 78*a* in its upper surface and the plate 79 may have the recessed portion 79*a* in its upper surface. In such a case, the recessed portion 78*a* of the plate 78 may define a lower portion of the supply manifold 51, thereby increasing the volume of the supply manifold 51.

Figure 5:
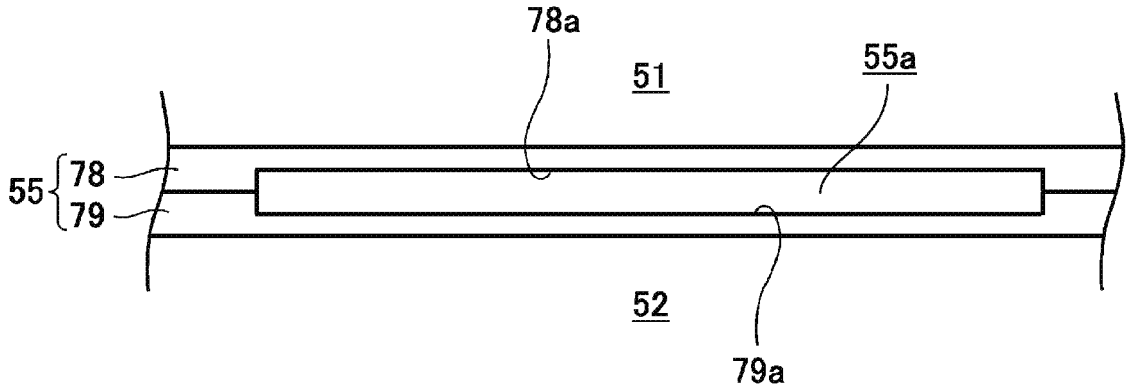
FIG. 5 is a sectional view illustrating another example of the damper portion of the head module of FIG. 3A according to the illustrative embodiment of the disclosure.

In still another example, as illustrated in FIG. 5, in the damper portion 55, the surface of the plate 78 where the recessed portion 78*a* is defined and the surface of the plate 79 where the recessed portion 79*a* is defined may be contacted to face each other.

In such a case, the volume of the damper space 55*a* of the damper portion 55 may be increased. Thus, a relatively large deformable range may be ensured with respect to the portion of the plate 78 where the recessed portion 78*a* is defined and the portion of the plate 79 where the recessed portion 79*a* is defined.

In the head module 13 illustrated in FIG. 4, the recessed portion 78*a* of the plate 78 may have the same length in the right-left direction as the recessed portion 79*a* of the plate 79. Nevertheless, in other embodiments, for example, the recessed portion 78*a* of the plate 78 may have a different length in the right-left direction from the recessed portion 79*a* of the plate 79. More specifically, for example, as illustrated in FIG. 6, the recessed portion 78*a* of the plate 78 defining the damper space 55*a* may be shorter in length in the right-left direction than the recessed portion 79*a* of the plate 79 defining the upper portion of the return manifold 52.

Figure 6:
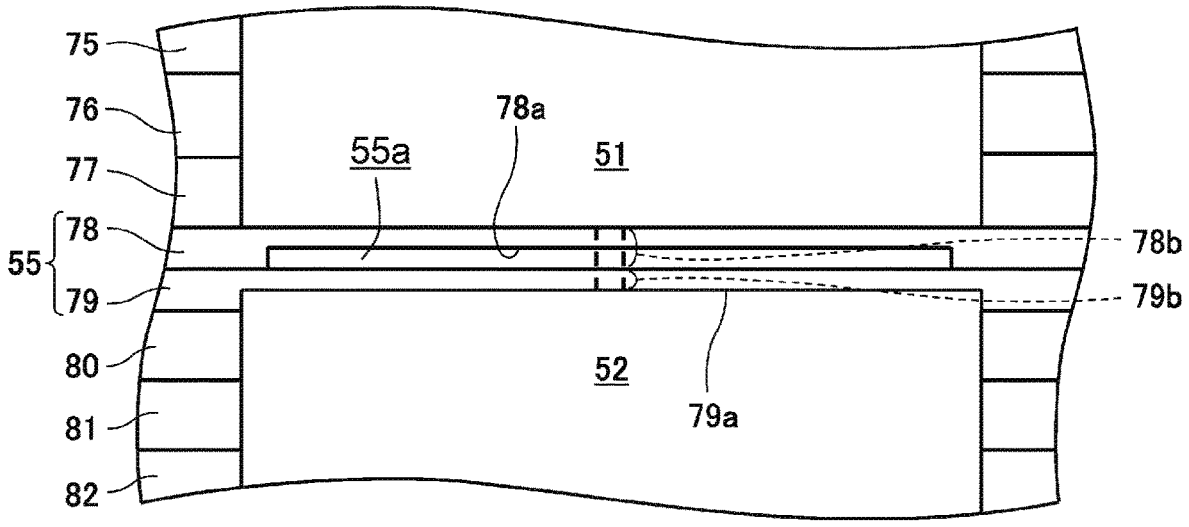
FIG. 6 is a sectional view illustrating still another example of the damper portion of the head module of FIG. 3 according to the illustrative embodiment of the disclosure.

According to the configuration illustrated in FIG. 6, even if lamination misalignment of the plates 78 and 79 occurs, the damper space 55*a* may have the same dimension and offer the same damper performance as a case where lamination misalignment of the plates 78 and 79 does not occur. Such a configuration may thus reduce or prevent from varying in damper performance among head modules 13. For example, in a case where the damper performance varies among head modules 13, even if voltage having the same waveform is applied to all of the head modules 13, a pressure wave propagates differently in a manifold of each head modules 13. Thus, ejection variations may occur among the head modules 13.

As illustrated in FIG. 6, the plate 78 may further have a first through hole 78*b* and the plate 79 may further have a second through hole 79*b*. The first through hole 78*b* is in fluid communication with the supply manifold 51. The second through hole 79*b* is in fluid communication with the return manifold 52 at its one end and in fluid communication with the first through hole 78*b* at its other end. The plate 78 and the plate 79 may have the first through hole 78*b* and the second through hole 79*b*, respectively, at respective portions where the damper portion 55 is not provided.

In such a case, manifold circulation may be implemented such that liquid is forced to flow from the supply manifold 51 at the positive pressure to the return manifold 52 at the negative pressure via the first through hole 78*b* and the second through hole 79*b* and is returned to a corresponding storage tank 16*a*. Such a manifold circulation may thus reduce or prevent, for example, intrusion of air bubbles, solid matter, or both into the individual channels 100 from the supply manifold 51.

In one example, the first through hole 78*b* and the second through hole 79*b* may have the same opening dimension. In another example, the first through hole 78*b* and the second through hole 79*b* may have respective different opening dimensions.

When the plate 78 and the plate 79 are laminated, the center of the first through hole 78*b* and the center of the second through hole 79*b* might not be aligned with each other. In expectation of such misalignment, for example, one of the first through hole 78*b* and the second through hole 79*b* may have a smaller opening diameter than the other. Such a configuration may ensure an opening dimension of at least one of the through holes 78*b* and 79*b* (i.e., the through hole 78*b* or 79*b* having a smaller opening) even if lamination misalignment of the plates 78 and 79 occurs.

Occupied Range of Damper Portion

Referring to FIGS. 3A and 3B, the occupied range of the damper portion 55 in the head module 13, that is, the occupied range of the recessed portion 78*a* of the plate 78 and the range area of the recessed portion 79*a* of the plate 79 will be described.

The occupied range of the recessed portion 78*a* of the plate 78 and the occupied range of the recessed portion 79*a* of the plate 79, that is, the occupied range of the damper portion 55, may preferably include an area or portions that may be influenced by residual vibration.

More specifically, for example, when viewed in plan from the nozzle surface, the damper portion 55 overlaps the exits 53*c* of the liquid supply paths 53. Thus, as compared with a configuration where the damper portion 55 does not overlap the exits 53*c* of the liquid supply paths 53 when viewed in plan from the nozzle surface, the configuration according to the illustrative embodiment may reduce the size of the head module 13 in a surface extending direction of the head module 13.

When viewed in plan from the nozzle surface, the damper portion 55 also overlaps with the entrances 53*b* of the liquid supply paths 53. Such a configuration may thus enable the damper portion 55 to reduce effects of residual vibration propagating to the supply manifold 51 through the supply narrowed portions 53*a* effectively. That is, the residual vibration propagating to the supply manifold 51 via the supply narrowed portions 53*a* travels downward in the laminating direction from the entrances 53*b*. As the damper portion 55 is positioned below and overlaps the entrances 53*b* of the liquid supply paths 53 when viewed in plan from the nozzle surface, the damper portion 55 may absorb residual vibration easily.

When viewed in plan from the nozzle surface, the damper portion 55 also overlaps the exits 54*b* of the liquid return paths 54. Such a configuration may thus enable the damper portion 55 to reduce effects of residual vibration propagating to the return manifold 52 through the return narrowed portions 54*a* effectively. That is, the residual vibration propagating to the return manifold 52 via the return narrowed portions 54*a* travels upward in the laminating direction from the exits 54*b* of the liquid return paths 54. As the damper portion 55 is positioned above and overlaps the exits 54*b* of the liquid return paths 54 when viewed in plan from the nozzle surface, the damper portion 55 may absorb residual vibration easily.

When viewed in plan from the nozzle surface, the damper portion 55 also overlaps the inlet 56. Such a configuration may thus enable the damper portion 55 to reduce effects of residual vibration propagating to the supply manifold 51 through the inlet 56 from a pump of a corresponding tank 16 effectively.

Deformation Volume of Damper Portion

Figure 7:
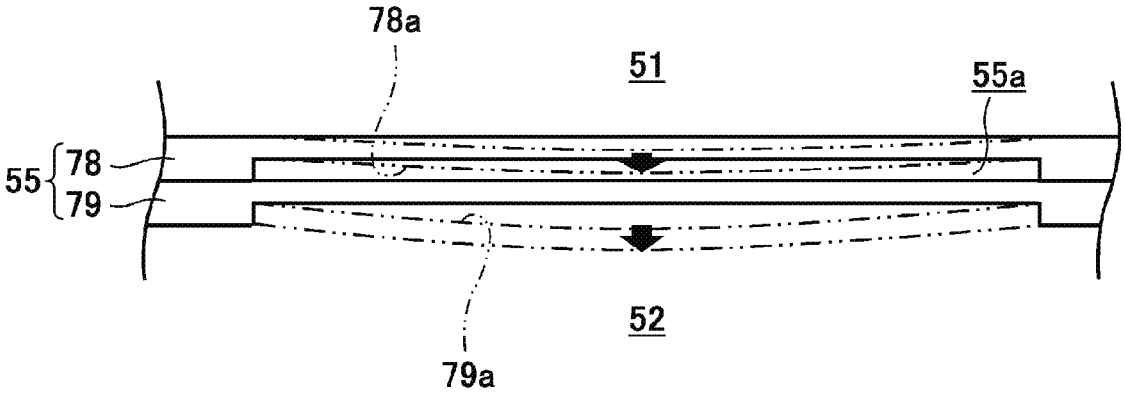
FIG. 7 is a schematic view illustrating particular plates whose portions having respective recessed portions are deformed by application of pressure thereto according to the illustrative embodiment of the disclosure.

Referring to FIG. 7, a deformable range of the damper portion 55 that is deformed responsive to pressure acting in the damper portion 55 will be described.

The supply manifold 51 is at the positive pressure. Thus, the recessed portion 78*a* of the plate 78 defining the supply manifold 51 is deformed toward the outside of the supply manifold 51, that is, downward in the laminating direction. In other words, as illustrated in FIG. 7, the portion of the plate 78 where the recessed portion 78*a* is defined is curved to protrude downward.

The return manifold 52 is at the negative pressure. Thus, the recessed portion 79*a* of the plate 79 defining the return manifold 52 is deformed toward the inside of the return manifold 52, that is, downward in the laminating direction. In other words, as illustrated in FIG. 7, the portion of the plate 79 where the recessed portion 79*a* is defined is curved to protrude downward.

In a case where a deformation volume of the recessed portion 78*a* of the plate 78 per unit pressure is greater than a deformation volume of the recessed portion 79*a* of the plate 79, the recessed portion 78*a* of the plate 78 may contact the recessed portion 79*a* of the plate 79. If such an event occurs, the damper portion 55 might not exert adequate damper performance.

In the illustrative embodiment, thus, the deformation volume of the recessed portion 78*a* of the plate 78 and the deformation volume of the recessed portion 79*a* of the plate 79 may be defined as described below.

An index that indicates the deformation volume of the recessed portion 78*a* of the plate 78 per unit pressure is represented by $C_{p1}$[mm$^2$/kPa]. An index that indicates the deformation volume of the recessed portion 79*a* of the plate 79 per unit pressure is represented by $C_{p2}$[mm$^2$/kPa]. An absolute value of pressure acting on liquid in the supply manifold 51 is represented by $P_1$[kPa]. An absolute value of pressure acting on liquid in the return manifold 52 is represented by $P_2$[kPa]. When $P_1 \leq P_2$, a relationship of $Cp1 \leq Cp2$ is satisfied. When $P_1 \leq P_2$, in order to satisfy the relationship of $C_{p1} \leq C_{p2}$, the deformation volume of the recessed portion 78*a* of the plate 78 per unit pressure is equal to or smaller than the deformation volume of the recessed portion 79*a* of the plate 79 per unit pressure. Such a configuration may thus reduce or prevent the deformed recessed portion 78*a* of the plate 78 from contacting the recessed portion 79*a* of the plate 79. Consequently, the damper portion 55 may exert its damper performance adequately.

The indexes $C_{p1}$ and $C_{p2}$ indicating the respective deformation volumes each indicate an amount of deformation of the damper portion 55 per unit pressure per unit manifold length.

If the deformation volume of the recessed portion 78*a* of the plate 78 per unit pressure and the deformation volume of the recessed portion 79*a* of the plate 79 per unit pressure are both too much, the volume of the return manifold 52 may decrease more than necessary. Thus, an upper limit of the deformation volume of the recessed portion 78*a* of the plate 78 and an upper limit of the deformation volume of the recessed portion 79*a* of the plate 79 may preferably be defined as described below.

That is, a relationship of $C_{p1} \leq 0.5\ P_1 \cdot A_1$ and a relationship of $C_{p2} \leq 0.5\ P_2 \cdot A_2$ are both satisfied where a cross sectional area of a cross section of the supply manifold 51 perpendicular to a direction in which liquid flows in the supply manifold 51 is represented by $A_1$[mm$^2$] and a cross sectional area of a cross section of the return manifold 52 perpendicular to a direction in which liquid flows in the return manifold 52 is represented by $A_2$[mm$^2$]. The liquid flow direction in the supply manifold 51 may refer to a direction in which liquid flows from the inlet 56 defined in one end portion of the supply manifold 51 toward the other end portion opposite to the one end portion of the supply manifold 51 to be supplied to each individual channel 100. The liquid flow direction in the return manifold 52 may refer to a direction in which liquid flows from each individual channel 100 toward the outlet 57 that is aligned with the inlet 56 in the manifold extending direction. In the illustrative embodiment, although the liquid flow direction in the supply manifold 51 and the liquid flow direction the return manifold 52 are opposite to each other, the cross section of each of the supply manifold 51 and the return manifold 52 perpendicular to the respective liquid flow direction may refer to the same cross section.

The deformation volume of the recessed portion 78*a* of the plate 78 per unit pressure and the deformation volume of the recessed portion 79*a* of the plate 79 per unit pressure may be controlled as described below. In a case where the recessed portion 78*a* and the recessed portion 79*a* are formed in the plate 78 and the plate 79, respectively, by half-etching, in one example, the deformation volumes may be controlled by an etching depth. In another example, the deformation volumes may be controlled by a thickness of each of the plates 78 and 79. In particular, the deformation volumes may be controlled preferably by both of the plate thickness and etching depth with respect to each of the plate 78 and the plate 79.

According to one or more aspects of the disclosure, a head module 13 may include a pressure chamber 50, a piezoelectric plate 60 (e.g., a piezoelectric member), a supply manifold 51, a return manifold 52, and a damper portion 55. The pressure chamber 50 may be configured to hold liquid therein and being in fluid communication with a nozzle orifice 18. The piezoelectric plate 60 may be configured to apply pressure to liquid held in the pressure chamber 50. The supply manifold 51 may be in fluid communication with the pressure chamber 50 and configured to allow liquid to flow into the pressure chamber 50 therefrom. The return manifold 52 may be in fluid communication with the pressure chamber 50 and configured to allow liquid not ejected from the nozzle orifice 18 to flow thereinto. The damper portion 55 may be positioned between the supply manifold 51 and the return manifold 52 when viewed in plan from a nozzle surface of the head module 13. The nozzle surface may have the nozzle orifice 18 defined therein. The damper portion 55 may include a particular plate having a particular recessed portion.

According to the above configuration, the head module 13 may have a relatively high handleability and a simple structure, and such a head module 13 may reduce residual vibration effect both in the supply manifold 51 and in the return manifold 52.

According to one or more aspects of the disclosure, in the head module 13 having the above configuration, the particular plate (e.g., a plate 78) may have the particular recessed portion (e.g., a recessed portion 78*a*) in a particular surface thereof and serve as one of outer walls defining the supply manifold 51. The damper portion 55 may further include a further particular plate (e.g., a plate 79) having a further particular recessed portion (e.g., a recessed portion 79*a*) in a further particular surface thereof and serve as one of outer walls defining the return manifold 52. The damper portion 55 may further include a damper space 55*a* defined between the particular plate and the further particular plate laminated one above another in a laminating direction.

In most cases, a damper portion capable of receiving both pressure acting on liquid in a supply manifold and pressure acting on liquid in a return manifold may need a plate A defining the supply manifold, a plate B defining a damper space for receiving volume change of the plate A due to pressure application, a plate C defining the return manifold, and a plate D defining a damper space for receiving volume change of the plate C due to pressure application.

According to the above configuration of the one or more aspects of the disclosure, in the head module 13, the damper portion 55 may have the damper space 55*a* defined between the particular plate having the recessed portion 78*a* and the further particular plate having the recessed portion 79*a* that may be laminated one above another in the laminating direction. Such a configuration might not require the plates for defining the damper space 55*a* (e.g., the plates B and D). Consequently, the number of plates for the damper portion 55 may be reduced, thereby enabling the head module 13 to have a simple structure.

According to one or more aspects of the disclosure, the head module 13 having the above configuration may further include a communication portion that may provide fluid communication between the damper space 55*a* and atmosphere.

With this configuration, air in the damper space 55*a* may be released to the atmosphere via the communication portion when the recessed portion 78*a* of the plate 78 or the recessed portion 79*a* of the plate 79 is deformed. Consequently, air resistance acting in the damper space 55*a* relative to deformation of the portion of the plate 78 where the recessed portion 78*a* may be defined or relative to deformation of the portion of the plate 79 where the recessed portion 79*a* may be defined may be reduced, thereby increasing absorbance of residual vibration.

According to one or more aspects of the disclosure, in the head module 13 having the above configuration, the damper space 55*a* may be a closed space.

Such a configuration may reduce or prevent intrusion of liquid such as ink into the damper space 55*a*, thereby not causing interruption of deformation of the damper portion 55 due to intrusion of liquid into the damper space 55*a*.

According to one or more aspects of the disclosure, in the head module 13 having the above configuration, the particular plate (e.g., the plate 78) and the further particular plate (e.g., the plate 79) may be laminated in the damper portion 55 such that the particular surface of the particular plate where the particular recessed portion (e.g., the recessed portion 78*a*) may be defined and the further particular surface of the further particular plate where the further particular recessed portion (e.g., the recessed portion 79*a*) may be defined may face the same direction in the laminating direction.

Such a configuration may thus increase the volume of one of the manifolds (e.g., the supply manifold 51 or the return manifold 52) that may be defined by the particular plate or the further particular plate whose surface having a recessed portion (e.g., the recessed portion 78*a* or 79*a*) serving as one of outer walls of the manifold.

According to one or more aspects of the disclosure, in the head module 13 having the above configuration, the particular plate and the further particular plate may be laminated in the damper portion 55 such that the particular surface of the particular plate where the particular recessed portion (e.g., the recessed portion 78*a*) may be defined and the further particular surface of the further particular plate where the further particular recessed portion (e.g., the recessed portion 79*a*) may be defined may face each other.

According to the above configuration, the damper space 55*a* may be defined by the recessed portion 78*a* of the particular plate and the recessed portion 79*a* of the further particular plate, thereby increasing the volume of the damper space 55*a*. Such a configuration may thus ensure a relatively large deformable range with respect to the portion of the particular plate where the recessed portion 78*a* may be defined and the portion of the further particular plate where the recessed portion 79*a* may be defined.

According to one or more aspects of the disclosure, in the head module 13 having the above configuration, the particular plate may further have a first through hole 78*b* being in fluid communication with the supply manifold 51. The further particular plate may further have a second through hole 79*b* being in fluid communication with the return manifold at one end thereof and being in fluid communication with the first through hole 78*b* at the other end thereof.

According to the above configuration, manifold circulation may be implemented such that liquid may be forced to flow from the supply manifold 51 at the positive pressure to the return manifold 52 at the negative pressure via the first through hole 78*b* and the second through hole 79*b*. Such a manifold circulation may thus reduce or prevent, for example, intrusion of air bubbles, solid matter, or both into the individual channels 100 from the supply manifold 51.

According to one or more aspects of the disclosure, in the head module 13 having the above configuration, the first through hole 78*b* of the particular plate and the second through hole 79*b* of the further particular plate may have respective different opening dimensions.

In a case where the first through hole 78*b* and the second through hole 79*b* each have a circular cross section, the opening dimension may refer to a diameter of each hole 78*b*, 79*b*. In a case where the first through hole 78*b* and the second through hole 79*b* each have a square cross section, the opening dimension may refer to a length of a side of each hole 78*b*, 79*b*.

In some cases, when the particular plate and the further particular plate are laminated, the center of the first through hole 78*b* and the center of the second through hole 79*b* might not be aligned with each other. According to the above configuration, in expectation of such misalignment, the first through hole 78*b* and the second through hole 79*b* may have respective different opening dimensions. More specifically, for example, one of the first through hole 78*b* and the second through hole 79*b* may have a smaller opening diameter than the other. Such a configuration may ensure an opening dimension of at least one of the through holes 78*b* and 79*b* (i.e., the through hole 78*b* or 79*b* having a smaller opening) even if lamination misalignment of the particular plate and the further particular plate occurs.

According to one or more aspects of the disclosure, the head module 13 having the above configuration may further include a supply narrowed portion 53*a* having an entrance 53*b* at one end thereof and an exit 53*c* at the other end thereof. The entrance 53*b* may be configured to allow liquid to flow into the supply narrowed portion 53*a* therethrough from the supply manifold 51. The exit 53*c* may be configured to allow liquid to flow toward the pressure chamber 50 therethrough from the supply narrowed portion 53*a*. The supply narrowed portion 53*a* may provide fluid communication between the supply manifold 51 and the pressure chamber 50. In such a head module 13, the recessed portion 78*a* of the particular plate and the recessed portion 79*a* of the further particular plate may overlap the exit 53*c* of the supply narrowed portion 53*a* when viewed in plan from the nozzle surface.

Thus, as compared with a configuration where the damper portion 55 does not overlap the exit 53*c* of the supply narrowed portion 53*a* when viewed in plan from the nozzle surface, such a configuration may reduce the size of the head module 13 in a surface extending direction of the head module 13.

According to one or more aspects of the disclosure, in the head module 13 having the above configuration, the recessed portion 78*a* of the particular plate and the recessed portion 79*a* of the further particular plate may overlap the entrance 53*b* of the supply narrowed portion 53*a* when viewed in plan from the nozzle surface.

Such a configuration may thus enable the damper portion 55 to reduce effects of residual vibration propagating to the supply manifold 51 through the supply narrowed portion 53*a* effectively.

According to one or more aspects of the disclosure, the head module 13 having the above configuration may further include a return narrowed portion 54*a* being in fluid communication with the nozzle orifice 18 at one end thereof and having an exit 54*b* at the other end thereof. The return narrowed portion 54*a* may provide fluid communication between the nozzle orifice 18 and the return manifold 52. In the head module 13, the recessed portion 78*a* of the particular plate and the recessed portion 79*a* of the further particular plate may overlap the exit 54*b* of the return narrowed portion 54*a* when viewed in plan from the nozzle surface.

Such a configuration may thus enable the damper portion 55 to reduce effects of residual vibration propagating to the return manifold 52 through the return narrowed portion 54*a* effectively.

According to one or more aspects of the disclosure, in the head module 13 having the above configuration, the supply manifold 51 may further include an inlet 56 that may allow liquid to flow into the supply manifold 51 therethrough from a tank 16. The recessed portion 78*a* of the particular plate and the recessed portion 79*a* of the further particular plate may overlap the inlet 56 of the supply manifold 51 when viewed in plan from the nozzle surface.

Such a configuration may thus enable the damper portion 55 to reduce effects of residual vibration propagating to the supply manifold 51 through the inlet 56 from a pump of a corresponding tank 16 effectively.

According to one or more aspects of the disclosure, in the head module 13 having the above configuration, the recessed portion 78*a* of the particular plate and the recessed portion 79*a* of the further particular plate may have respective different lengths.

In particular, one of the recessed portion 78*a* of the particular plate and the recessed portion 79*a* of the further particular plate may define the damper space 55*a*. The one of the recessed portion 78*a* of the particular plate and the recessed portion 79*a* of the further particular plate may be shorter in length than the other preferably.

According to the above configuration, the one recessed portion defining the damper space 55*a* may have a shorter length than the other recessed portion. Consequently, even if lamination misalignment of the particular plate and the further particular plate occurs, the damper space 55*a* may have the same dimension and offer the same damper performance as a case where lamination misalignment of the particular plate and the further particular plate does not occur. Such a configuration may thus reduce or prevent from varying in damper performance among head modules 13.

According to one or more aspects of the disclosure, in the head module 13 having the above configuration, the particular recessed portion (e.g., the recessed portion 78*a*) of the particular plate and the further particular recessed portion (e.g., the recessed portion 79*a*) of the further particular plate may have equal lengths.

In a case where the one recessed portion defines the damper space 55*a* and the other recessed portion defines one of the outer walls of one of the manifolds, such a configuration may thus increase the volume of the damper space 55*a* and the volume of the manifold as compared with a case where the recessed portion 78*a* and the recessed portion 79*a* have respective different lengths.

According to one or more aspects of the disclosure, in the head module 13 having the above configuration, in a case where $P_1 \leq P_2$, a relationship of $C_{p1} \leq C_{p2}$ may be satisfied where an index that indicates the deformation volume of the recessed portion 78*a* of the particular plate per unit pressure is represented by $C_{p1}$, an index that indicates the deformation volume of the recessed portion 79*a* of the further particular plate per unit pressure is represented by $C_{p2}$, an absolute value of pressure acting on liquid in the supply manifold 51 is represented by $P_1$, and an absolute value of pressure acting on liquid in the return manifold 52 is represented by $P_2$.

The portion of the particular plate where the recessed portion 78*a* may be defined may be deformed toward the outside of the supply manifold 51. The particular plate may be disposed corresponding to the supply manifold 51 at the positive pressure. The portion of the particular plate where the recessed portion 79*a* may be defined may be deformed toward the inside of the return manifold 52. The further particular plate may be disposed corresponding to the return manifold 52 at the negative pressure.

According to the above configuration, in a case where $P_1 \leq P_2$, in order to satisfy the relationship of $C_{p1} \leq C_{p2}$, the deformation volume of the particular recessed portion (e.g., the recessed portion 78*a*) of the particular plate per unit pressure may be equal to or smaller than the deformation volume of the further particular recessed portion (e.g., the recessed portion 79*a*) of the further particular plate per unit pressure. Such a configuration may thus reduce or prevent the deformed portion of the particular plate where the recessed portion 78*a* may be defined from contacting the portion of the further particular plate where the recessed portion 79*a* may be defined. Consequently, the damper portion 55 may exert its damper performance adequately.

According to one or more aspects of the disclosure, in the head module 13 having the above configuration, a relationship of $C_{p1} < 0.5\ P_1 \cdot A_1$ and a relationship of $C_{p1} \leq 0.5\ P_2 \cdot A_2$ may be both satisfied where a cross sectional area of a cross section of the supply manifold perpendicular to a direction in which liquid flows in the supply manifold is represented by $A_1$ and a cross sectional area of a cross section of the return manifold perpendicular to a direction in which liquid flows in the return manifold is represented by $A_2$.

According to the above configuration, the index $C_{p1}$ indicating the deformation volume of the recessed portion 78*a* of the particular plate per unit pressure may be $0.5\ P_1 \cdot A_1$ or smaller. The index $C_{p1}$ indicating the deformation volume of the recessed portion 79*a* of the further particular plate per unit pressure may be $0.5\ P_2 \cdot A_2$ or smaller. Such a configuration may thus reduce or prevent the portion of the particular plate where the recessed portion 78*a* may be defined and the portion of the further particular plate where the recessed portion 79*a* may be defined from being deformed largely by application of pressure, thereby reducing or preventing decrease of the volume of the return manifold 52.

The disclosure may be applied to, for example, an inkjet printer that may eject liquid droplets onto a sheet from nozzle orifices.

What is claimed is:

1. A head module comprising:

a pressure chamber configured to hold liquid therein and being in fluid communication with a nozzle orifice;

a piezoelectric member configured to apply pressure to liquid held in the pressure chamber;

a supply manifold being in fluid communication with the pressure chamber and configured to allow liquid to flow into the pressure chamber therefrom;

a return manifold being in fluid communication with the pressure chamber and configured to allow liquid not ejected from the nozzle orifice to flow thereinto; and a damper portion positioned between the supply manifold and the return manifold when viewed in plan from a nozzle surface of the head module, the nozzle surface having the nozzle orifice defined therein, the damper portion including:

a particular plate having a particular recessed portion in a particular surface thereof and serves as one of outer walls defining the supply manifold, and a further particular plate having a further particular recessed portion in a further particular surface thereof and serves as one of outer walls defining the return manifold; and a damper space defined between the particular plate and the further particular plate laminated one above another in a laminating direction, wherein the damper space is a closed space.

2. The head module according to claim 1, wherein the particular plate and the further particular plate are laminated in the damper portion such that the particular surface of the particular plate where the particular recessed portion is defined and the further particular surface of the further particular plate where the further particular recessed portion is defined face the same direction in the laminating direction.

3. The head module according to claim 2, wherein the particular recessed portion of the particular plate and the further particular recessed portion of the further particular plate have respective different lengths.

4. The head module according to claim 3, wherein one of the particular recessed portion of the particular plate and the further particular recessed portion of the further particular plate defines the damper space, and wherein the one of the particular recessed portion of the particular plate and the further particular recessed portion of the further particular plate is shorter in length than the other.

5. The head module according to claim 2, wherein the particular recessed portion of the particular plate and the further particular recessed portion of the further particular plate have equal lengths.

6. The head module according to claim 1, wherein the particular plate and the further particular plate are laminated in the damper portion such that the particular surface of the particular plate where the particular recessed portion is defined and the further particular surface of the further particular plate where the further particular recessed portion is defined are contacted to face each other.

7. The head module according to claim 1, wherein the particular plate further has a first through hole being in fluid communication with the supply manifold, and wherein the further particular plate further has a second through hole being in fluid communication with the return manifold at one end thereof and being in fluid communication with the first through hole at the other end thereof.

8. The head module according to claim 7, wherein the first through hole of the particular plate and the second through hole of the further particular plate have respective different opening dimensions.

9. The head module according to claim 1, further comprising a supply narrowed portion having an entrance at one end thereof and an exit at the other end thereof, the entrance configured to allow liquid to flow into the supply narrowed portion therethrough from the supply manifold, the exit configured to allow liquid to flow toward the pressure chamber therethrough from the supply narrowed portion, the supply narrowed portion providing fluid communication between the supply manifold and the pressure chamber, wherein the particular recessed portion of the particular plate and the further particular recessed portion of the further particular plate overlap the exit of the supply narrowed portion when viewed in plan from the nozzle surface.

10. The head module according to claim 9, wherein the particular recessed portion of the particular plate and the further particular recessed portion of the further particular plate overlap the entrance of the supply narrowed portion when viewed in plan from the nozzle surface.

11. The head module according to claim 1, further comprising a return narrowed portion being in fluid communication with the nozzle orifice at one end thereof and having an exit at the other end thereof, the return narrowed portion providing fluid communication between the nozzle orifice and the return manifold, wherein the particular recessed portion of the particular plate and the further particular recessed portion of the further particular plate overlap the exit of the return narrowed portion when viewed in plan from the nozzle surface.

12. The head module according to claim 1, wherein the supply manifold further includes an inlet that allows liquid to flow into the supply manifold therethrough from a tank, and wherein the particular recessed portion of the particular plate and the further particular recessed portion of the further particular plate overlap the inlet of the supply manifold when viewed in plan from the nozzle surface.

13. A head module comprising:

a pressure chamber configured to hold liquid therein and being in fluid communication with a nozzle orifice;

a piezoelectric member configured to apply pressure to liquid held in the pressure chamber;

a supply manifold being in fluid communication with the pressure chamber and configured to allow liquid to flow into the pressure chamber therefrom;

a return manifold being in fluid communication with the pressure chamber and configured to allow liquid not ejected from the nozzle orifice to flow thereinto;

a communication portion; and a damper portion positioned between the supply manifold and the return manifold when viewed in plan from a nozzle surface of the head module, the nozzle surface having the nozzle orifice defined therein, the damper portion including:

a particular plate having a particular recessed portion in a particular surface thereof and serves as one of outer walls defining the supply manifold, and a further particular plate having a further particular recessed portion in a further particular surface thereof and serves as one of outer walls defining the return manifold; and a damper space defined between the particular plate and the further particular plate laminated one above another in a laminating direction, wherein the communication portion provides fluid communication between the damper space and atmosphere.

14. A head module comprising:

a pressure chamber configured to hold liquid therein and being in fluid communication with a nozzle orifice;

a piezoelectric member configured to apply pressure to liquid held in the pressure chamber;

a supply manifold being in fluid communication with the pressure chamber and configured to allow liquid to flow into the pressure chamber therefrom;

a return manifold being in fluid communication with the pressure chamber and configured to allow liquid not ejected from the nozzle orifice to flow thereinto; and a damper portion positioned between the supply manifold and the return manifold when viewed in plan from a nozzle surface of the head module, the nozzle surface having the nozzle orifice defined therein, the damper portion including:

a particular plate having a particular recessed portion in a particular surface thereof and serves as one of outer walls defining the supply manifold, and a further particular plate having a further particular recessed portion in a further particular surface thereof and serves as one of outer walls defining the return manifold; and a damper space defined between the particular plate and the further particular plate laminated one above another in a laminating direction, wherein when $P_1 \leq P_2$, a relationship of $C_{p1} \leq C_{p2}$ is satisfied where an index that indicates the deformation volume of the particular recessed portion of the particular plate per unit pressure is represented by $C_{p1}$, an index that indicates the deformation volume of the further particular recessed portion of the further particular plate per unit pressure is represented by $C_{p2}$, an absolute value of pressure applied to liquid in the supply manifold is represented by $P_1$, and an absolute value of pressure applied to liquid in the return manifold is represented by $P_2$.

15. The head module according to claim 14, wherein a relationship of $C_{p1} \leq 0.5\ P_1 \cdot A_1$ and a relationship of $C_{p2} < 0.5\ P_2 \cdot A_2$ are both satisfied where a cross sectional area of a cross section of the supply manifold perpendicular to a direction in which liquid flows in the supply manifold is represented by $A_1$ and a cross sectional area of a cross section of the return manifold perpendicular to a direction in which liquid flows in the return manifold is represented by $A_2$.

* * * * *